US009927212B2

(12) United States Patent
Ota

(10) Patent No.: US 9,927,212 B2
(45) Date of Patent: Mar. 27, 2018

(54) TELESCOPABLE MULTI-FUNCTION KNIFE

(71) Applicant: Matthew J. Ota, Lynn, MA (US)

(72) Inventor: Matthew J. Ota, Lynn, MA (US)

( * ) Notice: Subject to any disclaimer, the term of this patent is extended or adjusted under 35 U.S.C. 154(b) by 288 days.

(21) Appl. No.: 14/757,295

(22) Filed: Dec. 14, 2015

(65) Prior Publication Data

US 2017/0167830 A1 Jun. 15, 2017

(51) Int. Cl.

| | |
|---|---|
| ***F41H 9/10*** | (2006.01) |
| ***B26B 11/00*** | (2006.01) |
| ***B26B 1/08*** | (2006.01) |
| ***F41B 13/00*** | (2006.01) |
| ***F21V 33/00*** | (2006.01) |

(52) U.S. Cl.

CPC ..... *F41H 9/10* (2013.01); *B26B 1/08* (2013.01); *B26B 11/008* (2013.01); *F21V 33/0084* (2013.01); *F41B 13/00* (2013.01)

(58) Field of Classification Search

CPC ..... F41H 9/10; B26B 1/08; B26B 11/008; B65D 83/752; F41B 13/00; F21V 33/0084

See application file for complete search history.

(56) References Cited

U.S. PATENT DOCUMENTS 2,993,586 A * 7/1961 Mosch ..... B26B 11/008 206/216
4,628,717 A 12/1986 Blum
4,751,621 A 6/1988 Jenkins
5,313,376 A 5/1994 McIntosh
D400,632 S 11/1998 Powell
5,941,629 A 8/1999 Tuscher
6,419,371 B1 7/2002 McCalla et al.
D467,634 S 12/2002 Eickhorn
6,554,163 B1 4/2003 Kaye
6,749,318 B1 * 6/2004 Palacios ..... B25F 1/003 30/169
6,791,816 B2 9/2004 Stethem
7,008,076 B2 3/2006 Zirk et al.
7,195,371 B2 3/2007 Thuma et al.
7,226,181 B2 6/2007 Galli
7,284,875 B2 10/2007 Kim
7,360,914 B2 4/2008 Kim
7,641,354 B1 1/2010 Valois et al.
8,316,492 B2 11/2012 Barber et al.
8,317,351 B2 11/2012 Brown et al.
8,363,376 B2 1/2013 Abatemarco
(Continued)

*Primary Examiner* — David B Thomas
(74) *Attorney, Agent, or Firm* — Don Halgren

(57) ABSTRACT

A one-hand operable telescopable knife assembly comprising an elongated outermost jacket enclosing an internal emission or containment chamber and an elongated knife blade assembly. A thumb stud is attached to and extends radially outwardly from the elongated knife blade assembly. The thumb stud extends slidingly through an elongated guide slot to permit a first locking notch to a second locking notch movement and control of the knife assembly contained within the outermost jacket. The first locking slot and the second locking slot are arranged at opposite ends of but are also arranged on the same side of the elongated guide slot. A transversely arranged slot on the blade assembly simultaneously lockingly engages a jacket locking tab at the second end of the outermost jacket upon rotation of the blade assembly by the thumb stud entering into the second locking slot on the side of the outermost jacket.

20 Claims, 6 Drawing Sheets

(56) References Cited

U.S. PATENT DOCUMENTS

| | | | | |
|---|---|---|---|---|
| 8,764,213 | B2 | 7/2014 | Cammenga et al. | |
| 8,771,085 | B1 | 7/2014 | Clyde et al. | |
| 2006/0097007 | A1 | 5/2006 | Motyka et al. | |
| 2007/0238532 | A1 | 10/2007 | Stethem | |
| 2009/0313765 | A1 | 12/2009 | Krudo | |
| 2010/0085739 | A1 | 4/2010 | Webb et al. | |
| 2011/0053694 | A1 | 3/2011 | Wood | |
| 2014/0252036 | A1 | 9/2014 | Ballard | |
| 2015/0285598 | A1* | 10/2015 | Flynn | F41H 9/10 239/289 |

* cited by examiner

TELESCOPABLE MULTI-FUNCTION KNIFE

BACKGROUND OF THE INVENTION

Field of the Invention

This invention relates to personal defensive devises and more particularly to multi-function knives which are capable of safely carrying and usable in situations where safety for the user is desirable, this application being based upon my Provisional Patent Application No. 62/124,314, filed on 15 Dec. 2014, which is incorporated herein by reference in its entirety.

Discussion of the Prior Art

The self defense art is replete with devices for carrying by individuals. These devices are often more dangerous to the carrier than to an opponent of the carrier. Examples of such devices include:

U.S. Pat. No. 8,771,085 which discloses a modular law enforcement baton at least 2 useful functions disposed at a first and a second end. Its useful tasks include providing light, providing a pepper spray, optical scanning, measuring the ridiculous speed, and measuring human blood alcohol levels. This is not a device which is readily carry both for self protection of an individual in a readily concealable manner;

U.S. Pat. No. 8,764,213 which discloses a lighted knife device is a knife blade, handle and a lighting device in a side of with a second lighting device arranged in a mirror fashion. This is interesting, however, as a self protection device it lacks ease-of-use in a difficult situation;

U.S. Pat. No. 8,363,376 discloses an apparatus with a metal detector, a light emitting source with a strobe feature, an electric stun system and a debilitating spray dispensing system. This is not a readily concealable or carryable device;

U.S. Pat. No. 8,317,351 discloses a knife which includes a knife blade and at least one light emitting member. This is more like a typical jackknife and anything else;

U.S. Pat. No. 8,316,492 discloses apparatus that may include a knife and a light, the looks of which seem too cumbersome;

U.S. Pat. No. 7,641,354 discloses an assembly that combines a flashlight with at least one secondary tool element. The tool element may be locked in an extended position in front of a flashlight or retracted back into a stored position along the casing of the flashlight. While this device appears to be useful in certain situations, its structure requires a two-handed operation which could be very disadvantageous in most defensive situations.

It is thus an object of the present invention to improve upon and overcome the disadvantages of the prior art.

It is a further object of the present invention to provide a self defense device which has the ability to be changed to different service capabilities while still maintaining its defensive characteristics.

It is yet a further object of the present invention to provide a multiple knife locking arrangement as part of a blade advance mechanism.

BRIEF SUMMARY OF THE INVENTION

The present invention comprises a telescopic multifunction knife assembly for the one-handed operation thereof. The knife assembly comprises an outermost cylindrically shaped jacket having a first end and a second end. The outermost jacket has a longitudinally arranged thumb stud guide slot extending from the first end and ending at a first jacket locking notch spaced apart from the second end of the outermost jacket. The second end of the outermost jacket is fully circumferential. A jacket locking tab extends radially inwardly from the perimeter of the second end of the outermost jacket.

An elongated knife blade assembly is slidably arranged completely within the outermost jacket. The elongated knife blade assembly has a distalmost portion consisting of a knife blade which is arcuate in its cross-sectional shape having an outer surface which conforms to the inner surface of the outermost jacket. The elongated knife blade has a proximal end which is attached to an annular collar. The attachment segment of the elongated knife blade comprises about 90° of the perimeter of the annular collar. A proximal portion of the elongated knife blade has a blade jacket locking tab there on. The blade jacket locking tab has a distal edge which is arranged at an acute angle with respect to the longitudinal axis of the elongated knife blade.

A jacket locking tab engaging notch is arranged between the proximal end of the blade jacket locking tab and the distalmost edge of the annular collar, to define a supplemental locking means for the elongated knife blade when it is in its distalmost operational configuration. The annular collar is dimensioned so as to be slidably advance the blade and allow it to be retractable within the outermost jacket. A blade lever tab extends off of the proximalmost edge of the annular collar. The blade lever tab is curved so as to conform to the shape of the inside surface of the outermost jacket. The blade lever tab helps keep the elongated knife blade aligned within the outermost jacket by its support of a thumb stud knife assembly release means.

The thumb stud is attached to the blade assembly and extends radially outwardly from the blade lever tab. The thumb stud preferably has an O-ring secured therearound, which O-ring is spaced apart from the outermost side of the blade lever tab. The thumb stud is arranged to be slidable within the longitudinally directed thumb stud guide slot, from the first end locking notch to the second end locking notch, having its radially outer end extend beyond the outermost jacket.

A cylindrically shaped replaceable internal emission chamber, such as for example, a pressurized pepper spray canister, or a flashlight or other insertable device, is slidably received into the central opening of the outermost jacket, wherein the elongated knife blade assembly slidably mates annularly therebetween.

In a further aspect of the present invention, a shoulder may be arranged about the perimeter of the internal emission chamber adjacent the first end of the outermost jacket. A compression spring may be disposed within the outermost jacket and around the outside of the internal emission chamber in abutting relationship to the shoulder thereon or to an internal edge of the outermost jacket, while also in an abutting relationship to the proximal perimeter of the annular collar of the elongated knife blade assembly.

A user's thumb engages displacement of the thumb stud extending from the blade lever tab at the first end of the multifunction knife assembly thus effecting the slippage of the thumb stud into the elongated guide slot and subsequent entry into the second locking notch close to the second end of the outermost jacket, such thumb stud displacement and concomitant elongated knife blade assembly advancement from the first end of the outermost jacket is thus effected by the compression spring forcing the annular collar towards the second end of that outermost jacket. In a further aspect of the present invention, it is to be noted that such thumb stud advancement into the second locking notch may also be accomplished manually by the user's one-handed thumb manipulation of the thumb stud from its resting location in the first end locking notch to the second locking notch.

The invention thus comprises a one-hand operable telescopable knife assembly comprising an elongated outermost jacket enclosing an internal emission chamber and an elongated knife blade assembly, wherein a thumb stud is attached to the elongated knife blade assembly, and wherein the thumb stud extends slidingly through an elongated guide slot to permit a first locking notch to a second locking notch movement and control of the knife assembly contained within the outermost jacket, wherein the first locking slot and the second locking slot are arranged on the same side of the elongated guide slot. The elongated knife blade assembly includes an annular collar arranged within the outermost jacket to facilitate controlled sliding movement of the elongated knife blade assembly within the outermost jacket. The annular collar is slidably disposed about a replacable internal emission chamber, and is also completely disposed within the elongated outermost jacket. The annular collar has a distal edge which is attached to a proximal end of an elongated knife blade. The elongated blade has a proximal end with a blade jacket locking tab thereon. The blade jacket locking tab has an acutely angled distal edge thereon. The blade jacket locking tab and the distal edge of the annular collar have a space therebetween which defines a further locking slot for the blade assembly onto a jacket locking tab on the second end of the elongated outermost jacket. A compression spring may be arranged within the first end of the outermost jacket to provide a bias force to advance the annular collar of the knife blade assembly towards a second end of the outermost jacket. The compression spring may be arranged to provide a rotational bias on the knife blade assembly to engage a first jacket locking notch onto the jacket locking tab on the second end of the elongated outermost jacket. The jacket locking tab extends radially inwardly on the second end of the outermost jacket.

The invention also comprises a telescopable knife arrangement for the single handed actuation of an extendable curvilinear knife blade and actuation of an emission or presentation from an internal emission or containment chamber, both the knife blade assembly and the internal emission chamber being disposed within a common elongated outermost jacket, wherein the curvilinear knife blade comprises a knife blade assembly being attached to a thumb stud and guided through an elongated guide slot by the thumb stud, the knife blade assembly having the thumb stud movable from a first locking notch in a first end of the outermost jacket to a second locking notch near the second end of the outermost jacket, both the first and second notches arranged on a common side of the elongated guide slot to facilitate biased locking of the knife blade assembly within the outermost jacket. The internal emission chamber may comprise a chemical spray arrangement. The internal emission or containment chamber may also comprise a flashlight arrangement, a baton, a flail arrangement, a personal care member such as a comb, a lighter, a razor, lipstick, pill carrier/dispenser and/or a survival kit or the like. The telescopable knife arrangement may include a coil spring arranged within the first end of the outermost jacket, the coil spring having a distal end in contact with a proximal edge of a collar portion of the blade assembly to provide bias movement of the blade assembly towards the second end of the outermost jacket. The knife arrangement may also include a snap-out biased locking spring attached to the outside surface of the blade to engage the distal end of the jacket, to lock the blade against undesired withdrawal of the blade back into the jacket, comprising a third locking arrangement for the blade assembly with respect to the jacket.

The invention also comprises a method of one-handedly operating a multi-function telescopable knife assembly comprising the steps of: arranging a blade assembly and an internal emission chamber within an elongated hollow outermost jacket, the outermost jacket having an open first end and an open second end, with a longitudinally directed guide slot extending from a locking notch at the first end and a locking slot arranged adjacent the second end of the outermost jacket; rotating the blade assembly within the outermost jacket about its longitudinal axis by thumb actuation of a thumb stud from a first locking notch on a first side of the guide slot; advancing the blade assembly towards the second end of the outermost jacket; and rotating the blade assembly within the outermost jacket about its longitudinal axis by movement of the thumb stud from the guide slot and into a second more distally located locking notch on a first side of the guide slot. The method may include arranging a coil spring within the first end of the outermost jacket to provide a bias applied against proximal edge of the blade assembly and towards the second end of the outermost jacket.

BRIEF DESCRIPTION OF THE DRAWINGS

The objects and advantages of the present invention will become more apparent when viewed in conjunction with the following drawings, in which.

DETAILED DESCRIPTION OF THE PRESENT INVENTION

Figure 1:
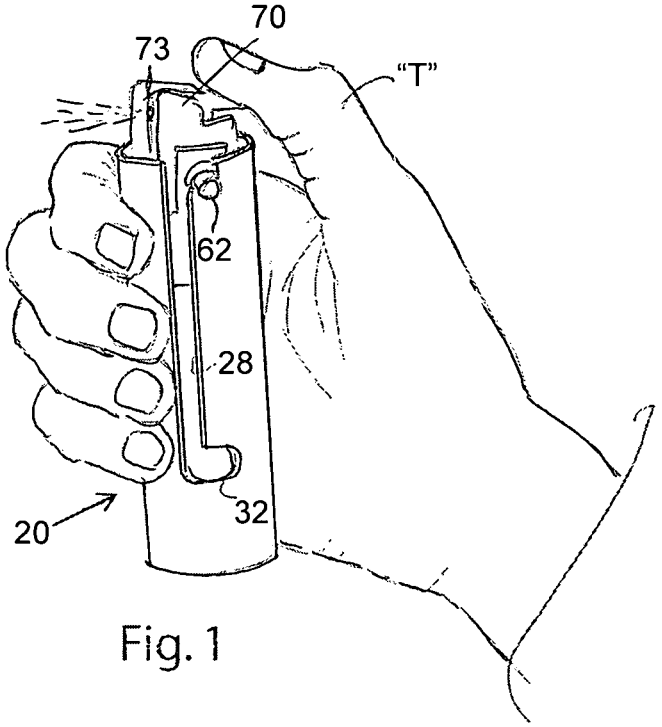
FIG. 1 is a perspective view of the telescoping multifunction knife assembly constructed according to the principles of the present invention.
Figure 15:
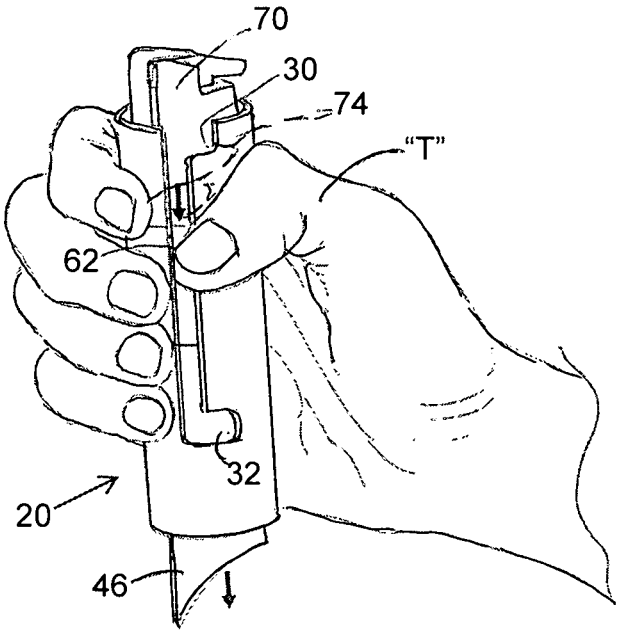
FIG. 15 is a perspective view of a user advancing the elongated multi-functioning knife blade assembly within the outermost jacket.
Figure 3:
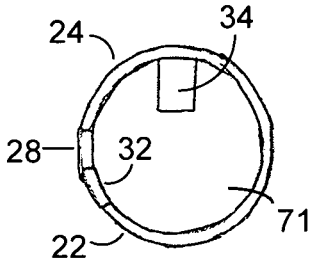
FIG. 3 is a view of the first end of the outermost jacket shown in FIG. 2.
Figure 2:
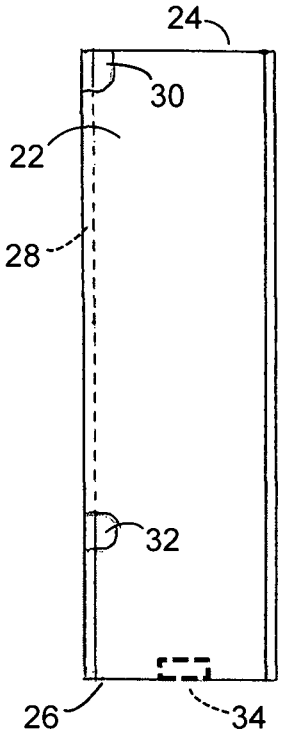
FIG. 2 is a side elevational view of the elongated outermost jacket forming the outer housing of the present invention.
Figure 4:
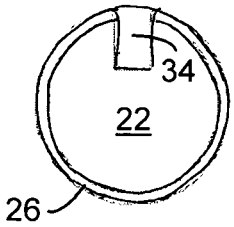
FIG. 4 is a view of the second end of the outermost jacket shown in FIG. 2.
Figure 16:
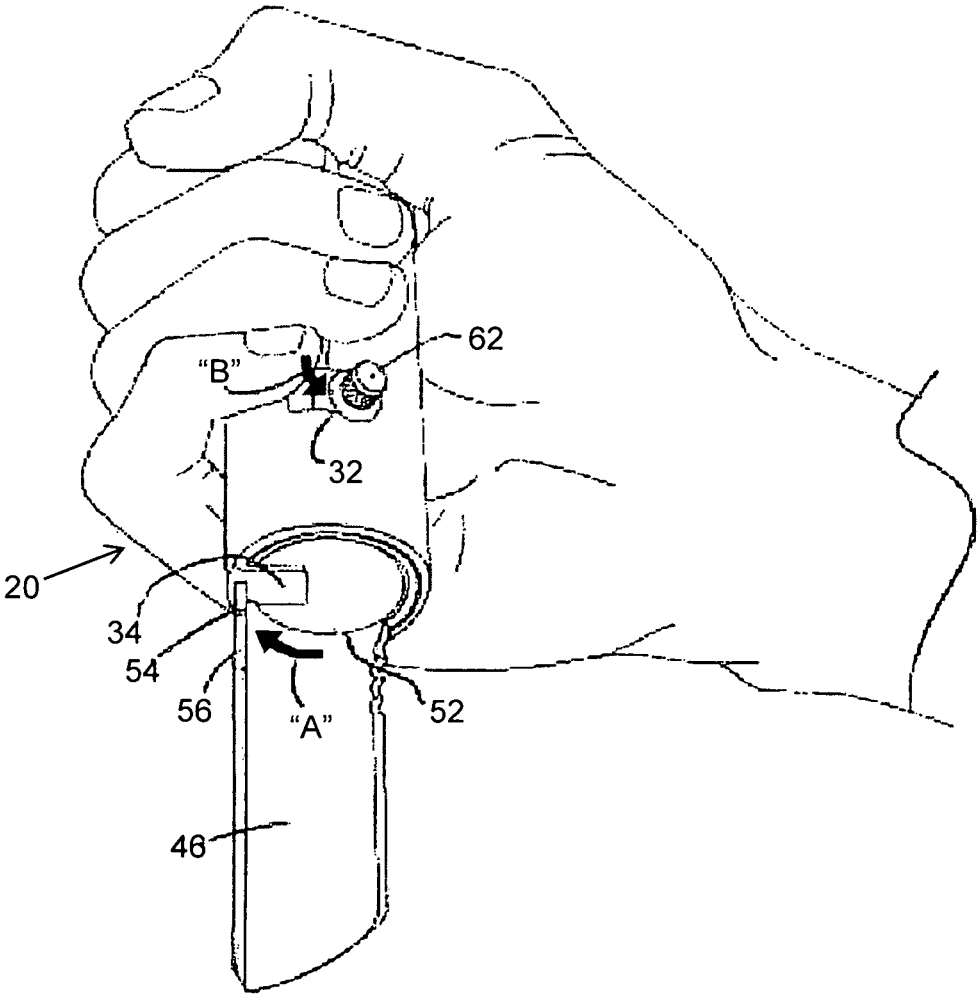
FIG. 16 is a perspective view of the knife displacement end of the elongated multifunctioning knife blade assembly indicating the multiple locking arrangements due to the rotation of the knife blade assembly about its longitudinal axis.

Referring now to the drawings in detail, and particularly to FIG. 1, there is shown the present invention which comprises an inventive telescopable multifunction knife assembly 20 for the one-handed operation thereof, as represented in FIGS. 1, 15 and 16. The knife assembly 20 comprises an elongated outermost cylindrically shaped jacket 22, as shown in FIG. 2, having a first end 24 and a second end 26, as shown in FIGS. 4 and 3. The outermost jacket 22 has a longitudinally arranged thumb stud guide slot 28 on its sidewall, as shown in FIGS. 2, 3, 11, 12, 13 and 14, which guide slot 28 extends from a first end locking notch 30 in the first end 24 of the outermost jacket 22, and ending at first locking arrangement at a second end locking notch 32, spaced apart from the second end 26 of the outermost jacket 22, as may be seen in FIGS. 2, 11, 12, 13 and 16. Each notch 30 and 32 are arranged on the same "side" of the thumb guide slot 28, as may be seen in FIGS. 11, 12 and 13. The second end 26 of the outermost jacket 22 is fully circumferential, as is represented in FIGS. 2, 11, 12, 13, 14 and 16. A jacket locking tab 34 extends radially inwardly from the perimeter of the second end 26 of the outermost jacket 22, as best represented in FIGS. 4, 14 and 16.

Figure 6:
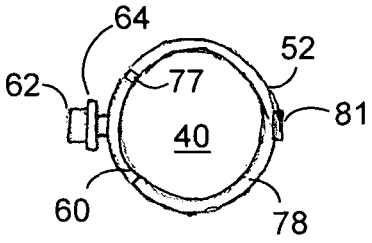
FIG. 6 is a view of the proximal end of the elongated knife blade assembly shown in FIG. 5.
Figure 5:
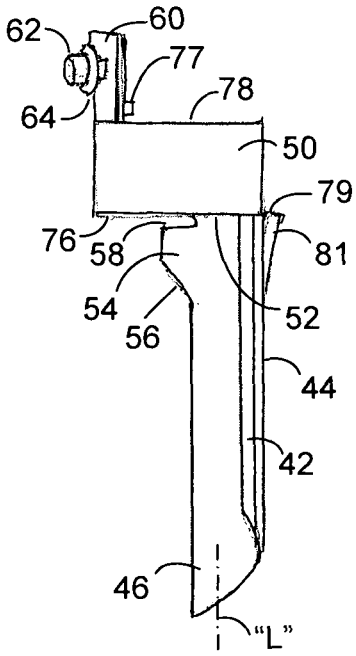
FIG. 5 is a side elevational view of the elongated knife blade assembly of the present invention.
Figure 7:
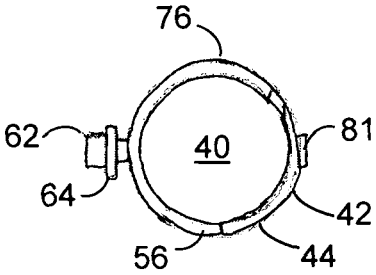
FIG. 7 is a view of the distalmost end of the elongated knife blade assembly shown in FIG. 5.

An elongated knife blade assembly 40, represented by itself in FIGS. 5, 6 and 7, is slidably arrangeable within and completely enclosed by the elongated outermost jacket 22. The elongated knife blade assembly 40 has a distalmost portion 42 consisting of a knife blade 46 which is arcuate in its cross-sectional shape, as may be seen in FIGS. 5, 7 and 12, having an outer surface 44 which conforms to the inner surface of the outermost jacket 22. The elongated knife blade 46 has a proximal end which is attached to an annular collar 50, best shown in FIG. 5. The attachment segment 52 of the elongated knife blade 46 comprises about 90° of the perimeter of the annular collar 50. A proximal portion of the elongated knife blade 46 has a blade jacket locking tab 54 thereon. The blade jacket locking tab 54 has a distal edge 56 which is arranged at an acute angle with respect to the longitudinal axis "L" of the elongated knife blade 46.

A transversely arranged jacket locking tab engaging notch 58, shown best in FIG. 5, is arranged between the proximal end of the blade jacket locking tab 54 and the distalmost edge 76 of the annular collar 50, to define a second or supplemental automatic locking arrangement for the elongated knife blade 46 when it is in its distalmost operational configuration, as is represented in FIG. 16, and rotated as indicated by the arrow "A", wherein the thumb stud 62 rotatively engages into locking notch 32 as indicated by arrow "B" and transversely arranged jacket locking tab engaging notch 58 on the blade assembly also receives jacket locking tab 34 simultaneously therewith, as represented in FIG. 16. The annular collar 50 is dimensioned so as to be slidably and permit the advance of the knife blade 46 and also allow it to be retractable within the outermost jacket 22.

A blade lever tab 60 extends off of the proximalmost edge 78 of the annular collar 50, as shown in FIGS. 5 and 6. The blade lever tab 60 is curved, as shown in FIG. 6, so as to conform to the shape of the inside surface of the outermost jacket 22. The blade lever tab 60 helps keep the elongated knife blade 46 aligned within the outermost jacket 22 by its guided support of the thumb stud 62.

The thumb stud 62 extends radially outwardly from and attaches to the blade assembly 40 via the blade lever tab 60 on the proximal end of the knife blade assembly 40 as shown in FIGS. 5, and 6, and permits advancement and retraction of the knife blade assembly 40 relative to the outermost jacket 22. The thumb stud 62 preferably has an O-ring 64 secured therearound, which O-ring 64 is adjacent or spaced apart from the outermost side of the blade lever tab 60, as shown in FIGS. 6 and 7. The thumb stud 62 is arranged to be slidable within the longitudinally directed thumb stud guide slot 28, from the first end locking notch 30 to the second end locking notch 32, having its radially outer end extend beyond the outermost jacket 22, as stepwise represented in FIGS. 11, 12 and 13.

Figure 9:
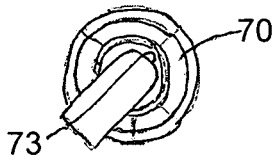
FIG. 9 is a view of the business end of the replaceable internal emission chamber shown in FIG. 8.
Figure 8:
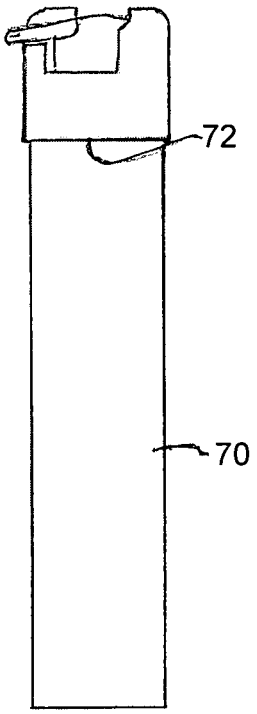
FIG. 8 is a side elevational view of a replaceable internal emission chamber utilizable within outermost jacket.
Figure 10:
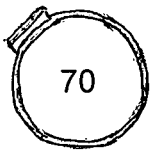
FIG. 10 is a view of the bottom end of the replaceable internal emission chamber shown in FIG. 8.
Figure 11:
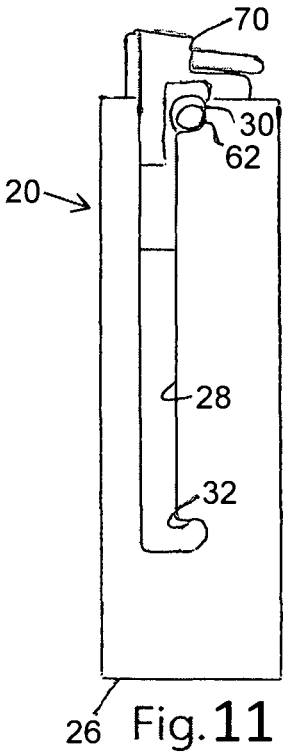
FIG. 11 is a side elevational view of the telescoping multi-functioning knife blade assembly showing the elongated blade assembly fully retracted within the outermost jacket and the business and of the internal emission chamber extending from the first end thereof.
Figure 12:
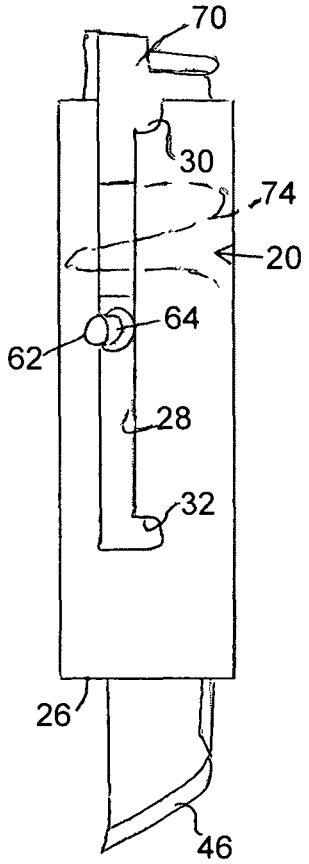
FIG. 12 is a side elevational view of the telescoping multi-functioning knife blade assembly showing the elongated blade assembly partially displaced from the outermost jacket.
Figure 13:
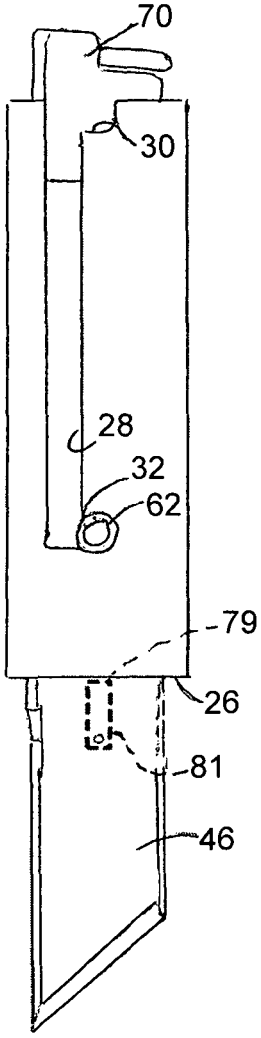
FIG. 13 is a side elevational view of the telescoping multi-functional knife blade assembly similar to FIG. 12, now showing the elongated blade assembly fully extended from the outermost jacket, with its thumb stud locked within the second locking notch.
Figure 14:
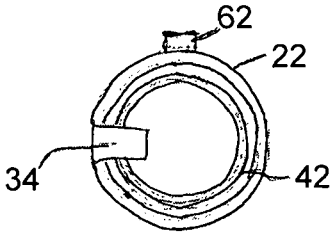
FIG. 14 is an end view of the telescoping multi functioning knife blade assembly shown in FIG. 11.

A cylindrically shaped replaceable internal emission chamber 70, such as for example, a pressurized pepper spray canister with a thumb actuatable spray nozzle 73 shown in FIGS. 1 and 15, (or a flashlight or the like, not depicted here for clarity of drawings), shown in FIGS. 8, 9 and 10, is slidably received into the central opening 71 of the outermost jacket 22, as represented in FIG. 11, wherein the elongated knife blade assembly 40 slidably mates annularly therebetween, see in FIGS. 11, 12 and 13.

In a further aspect of the present invention, a shoulder 72 may be arranged about the perimeter of the internal emission/container chamber 70, as shown in FIG. 8, when assembled, placing it adjacent the first end of the outermost jacket 22. A compression spring 74 may be disposed within the outermost jacket 22 and around the outside of the internal emission chamber 70 in the abutting relationship to an anchor point 77 on the shoulder 72 thereon as shown in FIG. 5, and in an abutting relationship to the proximal perimeter 78 of the annular collar 50 of the elongated knife blade assembly 40, to enable the rotational bias of the collar 50 and hence drive the thumb stud 62 lockingly into the second slot 32.

In yet a further aspect of the present invention, a leaf spring 81, as shown in FIG. 5, and shown in dashed lines in FIG. 13, is attached to the outer surface 44 of the blade assembly 46, has a distal end 79, arranged to lockingly engage the second end 26 of the outermost jacket 22 when the blade assembly 20 is advanced outwardly from the elongated outermost jacket 22, as represented in FIGS. 13 and 16, to define a third locking arrangement for the knife assembly 20.

A user's thumb "T" engaged displacement of the thumb stud 62 extending from the blade lever tab 60 at the first end of the multifunction knife assembly 20, see FIG. 15, effects the slippage of the thumb stud 62 into the elongated guide slot 28 and entry into the second locking notch 32 close to the second end 26 of the outermost jacket 22. Such thumb stud displacement and concomitant elongated knife blade assembly advancement from the second end 26 of the outermost jacket 22 may also be effected by the biasing action of the compression spring 74, represented in FIG. 12, forcing the annular collar 50 towards the second end 26 of the outermost jacket 22, as shown in FIG. 13, and into the second end locking slot 32, since both slots 30 and 32 are on a common side of the guide slot 28. The thumb stud 62 may thus be spring 74 biased into the second end locking slot 32.

It is to be noted that such advancement may also be accomplished manually by the user's one-handed manipulation of the thumb stud 62 from its resting location in the first end locking notch 30 to the second locking notch 32 as may be envisaged in FIGS. 15 and 16.

I claim:

1. A one-hand operable telescopable knife assembly comprising:

an elongated outermost jacket enclosing an internal replacable chamber and an elongated knife blade assembly, wherein a thumb stud is attached to the elongated knife blade assembly, and wherein the thumb stud extends slidingly through an elongated guide slot to permit a first locking notch to a second locking notch movement and control of the knife assembly contained within the outermost jacket, wherein the first locking slot and the second locking slot are arranged on the same side of the elongated guide slot.

2. The telescopable knife assembly as recited in claim 1, wherein the elongated knife blade assembly includes an annular collar arranged within the outermost jacket to facilitate controlled sliding movement of the elongated knife blade assembly within the outermost jacket.

3. The telescopable knife assembly as recited in claim 2, wherein the annular collar is slidably disposed about a replacable internal emission chamber, and is also completely disposed within the elongated outermost jacket.

4. The telescopable knife assembly as recited in claim 3, wherein the annular collar has a distal edge which is attached to a proximal end of an elongated knife blade.

5. The telescopable knife assembly as recited in claim 4, wherein the elongated blade has a proximal end with a blade jacket locking tab thereon.

6. The telescopable knife assembly as recited in claim 5, wherein the blade jacket locking tab has an acutely angled distal edge thereon.

7. The telescopable knife assembly as recited in claim 6, wherein the blade jacket locking tab and the distal edge of the annular collar have a space therebetween which defines a transversely arranged locking slot for the blade assembly onto a jacket locking tab on the second end of the elongated outermost jacket for simultaneous rotatively induced double locking thereof.

8. The telescopable knife assembly as recited in claim 2, wherein a compression spring is arranged within the first end of the outermost jacket to provide a bias force to advance the annular collar of the knife blade assembly towards a second end of the outermost jacket.

9. The telescopable knife assembly as recited in claim 8, wherein the compression spring is arranged to provide a rotational bias on the knife blade assembly to engage a first jacket locking notch onto the jacket locking tab on the second end of the elongated outermost jacket.

10. The telescopable knife assembly as recited in claim 9, wherein the jacket locking tab extends radially inwardly on the second end of the outermost jacket.

11. The telescopable knife assembly as recited in claim 1 wherein the replacable chamber is selected from the group consisting of: a spray device, a light, a flame device, a personal care device, a baton, and a gun mechanism.

12. A telescopable knife arrangement for the single handed actuation of an extendable curvilinear knife blade and actuatable emission from an internal emission chamber, both the knife blade assembly and the internal emission chamber being disposed within a common elongated outermost jacket, wherein the curvilinear knife blade comprises a knife blade assembly being attached to a thumb stud and guided through an elongated guide slot by the thumb stud, the knife blade assembly movable when the thumb stud is movable from a first notch in a first end of the outermost jacket to a second locking notch near the second end of the outermost jacket, both the first and second notches arranged on a common side of the elongated guide slot to facilitate rotatable locking of the knife blade assembly with the jacket locking notch in the side of the outermost jacket, and a simultaneous rotative engagement of a transversely arranged slot on the blade assembly with a jacket locking tab on the second end of the outermost jacket.

13. The telescopable knife arrangement as recited in claim 12, wherein the internal emission chamber comprises a chemical spray arrangement.

14. The telescopable knife arrangement as recited in claim 12, wherein the internal emission chamber comprises a flashlight arrangement.

15. The telescopable knife arrangement as recited in claim 12 includes a coil spring arranged within the first end of the outermost jacket, the coil spring having a distal end in contact with a proximal edge of a collar portion of the blade assembly to provide bias movement of the blade assembly towards the second end of the outermost jacket.

16. The telescopable knife assembly as recited in claim 12, including a leaf spring attached to an outer surface of the blade assembly to lockably engage the second end of the jacket comprising a third locking arrangement of the knife arrangement.

17. A method of one-handedly operating a multi-function telescopable knife assembly comprising the steps of:

arranging a blade assembly and an internal emission chamber within an elongated hollow outermost jacket, the outermost jacket having an open first end and an open second end, with a longitudinally directed guide slot extending from a locking notch at the first end and a locking slot arranged adjacent the second end of the outermost jacket;

rotating the blade assembly within the outermost jacket about its longitudinal axis by thumb actuation of a thumb stud from a first locking notch on a first side of the guide slot;

advancing the blade assembly towards the second end of the outermost jacket; and rotating the blade assembly within the outermost jacket about its longitudinal axis by movement of the thumb stud from the guide slot and into a second more distally located locking notch on a first side of the guide slot.

18. The method of one-handedly operating a multi-function telescopable knife assembly as recited in claim 17, including:

mating a locking tab on the second end of the outermost jacket with a transversely arranged slot on the blade assembly simultaneously with the engagement of the thumb stud into the second locking notch.

19. The method of one-handedly operating a multi-function telescopable knife assembly as recited in claim 17, including:

arranging a coil spring within the first end of the outermost jacket to provide a bias applied against proximal edge of the blade assembly and towards the second end of the outermost jacket.

20. The method of one-handedly operating a multi-function telescopable knife assembly as recited in claim 17, including:

arranging a leaf spring on an outer surface of the blade assembly so as to function as a third locking arrangement to keep the knife assembly from undesired retraction in the jacket.

* * * * *